US012329258B2

(12) United States Patent
Louisdhon

(10) Patent No.: US 12,329,258 B2
(45) Date of Patent: Jun. 17, 2025

(54) ENHANCED SPORTING EQUIPMENT BAG

(71) Applicant: Valery Louisdhon, Tampa, FL (US)

(72) Inventor: Valery Louisdhon, Tampa, FL (US)

( * ) Notice: Subject to any disclaimer, the term of this patent is extended or adjusted under 35 U.S.C. 154(b) by 98 days.

(21) Appl. No.: 18/244,934

(22) Filed: Sep. 12, 2023

(65) Prior Publication Data

US 2024/0090633 A1 Mar. 21, 2024

Related U.S. Application Data

(60) Provisional application No. 63/407,519, filed on Sep. 16, 2022.

(51) Int. Cl.

| | |
|---|---|
| ***A45C 3/00*** | (2006.01) |
| ***A45C 13/10*** | (2006.01) |
| ***A45F 3/02*** | (2006.01) |
| ***A63B 47/00*** | (2006.01) |

(52) U.S. Cl.

CPC ..... *A45C 3/001* (2013.01); *A45C 13/103* (2013.01); *A45C 2003/002* (2013.01); *A45C 2003/007* (2013.01)

(58) Field of Classification Search

CPC ... A63B 47/007; A63B 47/00; A63B 71/0036; A63B 2243/0025; A45C 3/001; A45C 11/00; A45C 13/103; A45C 2003/002; A45C 2003/007; A45F 3/04; A45F 3/02; Y10S 224/919; Y10S 383/907

USPC ..... 206/315.1

See application file for complete search history.

(56) References Cited

U.S. PATENT DOCUMENTS

| | | | | |
|---|---|---|---|---|
| 4,214,684 A * | 7/1980 | Galowitz | A63B 47/00 294/166 |
| D290,064 S * | 6/1987 | Whitaker | D3/244 |
| 5,386,906 A * | 2/1995 | Lai | A63B 47/00 206/315.9 |
| 5,458,278 A * | 10/1995 | LaConte | A45F 3/04 224/652 |
| 5,490,619 A * | 2/1996 | Boyar | A45F 3/02 224/613 |
| 5,927,581 A * | 7/1999 | Reddy | A45F 3/04 224/655 |
| 6,367,674 B1 * | 4/2002 | Tabor | A45F 3/04 224/653 |
| 6,386,414 B1 * | 5/2002 | Kilduff | A45C 13/02 383/102 |
| 6,439,389 B1 * | 8/2002 | Mogil | B65D 81/3897 206/217 |

(Continued)

*Primary Examiner* — Gideon R Weinerth

(74) *Attorney, Agent, or Firm* — Origins Law, LLC; Nicholas Spatola

(57) ABSTRACT

The present invention is directed to a soccer training equipment bag that accommodates 20 size-5 soccer balls. It incorporates stretchable mesh panels that evenly distribute the pressure exerted by the balls, enhancing bag durability. Side pockets provide storage for training vests, with clear options for breathability and opaque options for privacy. Additional compartments, including a unique bottom compartment, offer versatile storage for equipment such as pop-up soccer goals, tactics boards, and agility rings. The bag's design includes features like side handles for tandem carrying, a hook-and-loop pump holder, drainage capability, and an easily adjustable strap with a key holder. The multifunctional design caters specifically to coaches overseeing larger groups of players.

18 Claims, 6 Drawing Sheets

(56) References Cited

U.S. PATENT DOCUMENTS 6,467,665 B1 * 10/2002 Jenkins ..... A45F 3/04 224/628
6,892,916 B1 * 5/2005 Rugg ..... A63B 47/00 224/605
7,958,920 B1 * 6/2011 Olsson ..... A45C 3/001 190/110
D927,173 S * 8/2021 Kawamoto ..... A45F 3/04 D3/217
D1,018,033 S * 3/2024 Dai ..... D3/202
D1,059,021 S * 1/2025 Pleje ..... D3/300
2003/0150537 A1 * 8/2003 Hauptman ..... A63B 60/58 206/315.9
2003/0228072 A1 * 12/2003 Tyberg ..... B65D 23/0892 383/29
2004/0149600 A1 * 8/2004 Wolter ..... A45C 13/02 206/223
2004/0231771 A1 * 11/2004 Shiue ..... A45C 3/001 150/107
2005/0011785 A1 * 1/2005 Nish ..... A45C 3/00 206/315.1
2006/0228051 A1 * 10/2006 Yu ..... A45C 7/0077 224/153
2012/0145718 A1 * 6/2012 Quarry ..... A45C 11/20 220/507
2013/0228483 A1 * 9/2013 Byers ..... A45F 3/04 206/315.9
2013/0320054 A1 * 12/2013 Kruse ..... A45C 3/00 224/191
2016/0045789 A1 * 2/2016 Byers ..... A63B 47/00 206/315.9
2016/0174693 A1 * 6/2016 Pompliano ..... A45F 3/04 224/153
2018/0271245 A1 * 9/2018 Glover ..... A45C 13/001
2022/0202171 A1 * 6/2022 Vu ..... A45C 13/30
2023/0210235 A1 * 7/2023 Hidalgo ..... A63B 29/08 206/579
2023/0225471 A1 * 7/2023 Togbah ..... A45C 13/02 206/315.1
2024/0023683 A1 * 1/2024 Adams, I ..... A45C 13/103
2024/0090633 A1 * 3/2024 Louisdhon ..... A45C 3/001

* cited by examiner

ENHANCED SPORTING EQUIPMENT BAG

CROSS-REFERENCE TO RELATED APPLICATIONS

This application claims priority under 35 U.S.C. § 119(e) of U.S. Provisional Patent Application Ser. No. 63/407,519, filed Sep. 16, 2022, and entitled "ENHANCED SPORTING EQUIPMENT BAG", which is hereby incorporated by reference in its entirety.

FIELD OF THE INVENTION

The present invention relates broadly to bags for carrying sporting equipment and the like.

BACKGROUND

Current soccer ball and sporting equipment bags are limited in capacity and functionality. They only carry soccer balls in a singular internal compartment. Further, the number of Size 5 soccer balls vary between 12-16 balls for medium to large size bags. This market-standard construction may be appropriate merely for the transportation of soccer balls, but when more equipment is needed, for instance for traveling sports teams or non-permanent sporting events and practices, more equipment and a higher capacity is needed. Most solve this problem by simply increasing the number of mesh ball carriers and equipment bags, however, with an increase in the number of bags, a higher likelihood of leaving something behind arises.

However, inefficiencies in technology and construction were amplified by the COVID-19 virus outbreak, leading to months of soccer training with an increase in restriction on how to train players. The players were not allowed to touch the balls and they could only wear one training vest, these guidelines were put in place for every piece of equipment that the players could come into contact. The current ball bags were not designed to help coaches stay organized and prevent infection. This resulted in a need for equipment carriers with, not only increased space, but uniquely configured compartments and arrangements to accommodate the increase in variety of equipment that must be carried by a single person.

Further, while the COVID-19 virus outbreak may have been a catalyst in the need for more complex carrying systems, however, a need has always existed in the market for an enhanced multi-use soccer equipment bag, capable of hauling more soccer balls, more gear, and other equipment, in a uniquely configured and easy to use and utilize sporting equipment bag.

SUMMARY OF THE INVENTION

The invention disclosed herein provides a multifunctional sports equipment bag configured for versatile use, storage, and transport is provided. The multifunctional sports equipment bag is configured for versatile use, storage, and transport comprises a central containment compartment comprised of malleable cylindrical body of flexible and stretchable materials. Geometrically, the central containment compartment is bordered by an open upper area and an integrated base panel at a lowermost area. The multifunctional sports equipment bag configured for versatile use, storage, and transport also includes a plurality of integrated surface mounted pockets, a plurality of integrated surface attached drawstring pouches, a plurality of drainage holes, and an integrated hook and loop air pump holder comprising two hook and loop straps. The hook and loop straps are configured to a location where affixing an air pump will be unobstructed, such as toward a top of the bag, and should be oriented to keep the air pump horizontal so it does not slide out from its own weight.

Further provided in the inventive disclosure of the multifunctional sports equipment bag configured for versatile use, storage, and transport is a chest strap affixed to an outer surface of a back side of the central containment compartment, wherein a bottom end of the chest strap is affixed at lower area of the central containment compartment, and a top end is affixed at a location towards an upper closable opening at the open upper area.

Yet further provided in the inventive disclosure of the multifunctional sports equipment bag configured for versatile use, storage, and transport is the integrated base panel defining a lower closable opening at a lower area of the central containment compartment attached by a concentric zipper attaching an upper boundary of the integrated base panel to a lowermost boundary of the central containment compartment.

The invention disclosed herein also provides a method of configuring a multifunctional sports equipment bag for versatile use, storage, and transport is provided. The method comprises providing a central containment compartment comprised of malleable cylindrical body of flexible and stretchable materials, wherein the central containment compartment is bordered by an open upper area and an integrated base panel at a lowermost area, and the integrated base panel defines a lower closable opening at a lower area of the central containment compartment attached by a concentric zipper attaching an upper boundary of the integrated base panel to a lowermost boundary of the central containment compartment. The method also includes providing a plurality of integrated surface mounted pockets, providing a plurality of integrated surface attached drawstring pouches, providing a plurality of drainage holes, providing an integrated hook and loop air pump holder comprising two hook and loop straps, and providing a chest strap affixed to an outer surface of a back side of the central containment compartment, wherein a bottom end of the chest strap is affixed at lower area of the central containment compartment, and a top end is affixed at a location towards an upper closable opening at the open upper area.

It is an object of the present invention to provide a sporting equipment bad that is capable of being an all-inclusive soccer training system, capable of carrying and servicing several different types and pieces of equipment in a single inclusive bag design.

It is an object of the present invention to provide a system capable of carrying an expanded capacity of soccer balls above the standard maximum of 16.

It is yet another object of the present invention is to provide a system capable of displaying an easily accessible plurality of pockets configured to hold a minimum of 15 training vests per pocket.

It is a further object to provide a compartment including and capable of carrying foldable goals and coach tactical pads, as well as cones of various geometries.

The drawings and specific descriptions of the drawings, as well as any specific or alternative embodiments discussed, are intended to be read in conjunction with the entirety of this disclosure. The invention may be embodied in many different forms and should not be construed as being limited to the embodiments set forth herein; rather, these embodiments are provided by way of illustration only and so that this disclosure will be thorough, complete and fully convey understanding to those skilled in the art. The above and yet other objects and advantages of the present invention will become apparent from the hereinafter set forth Brief Description of the Drawings, Detailed Description of the Invention, and Claims appended herewith.

DETAILED DESCRIPTION OF THE INVENTION

Figure 1:
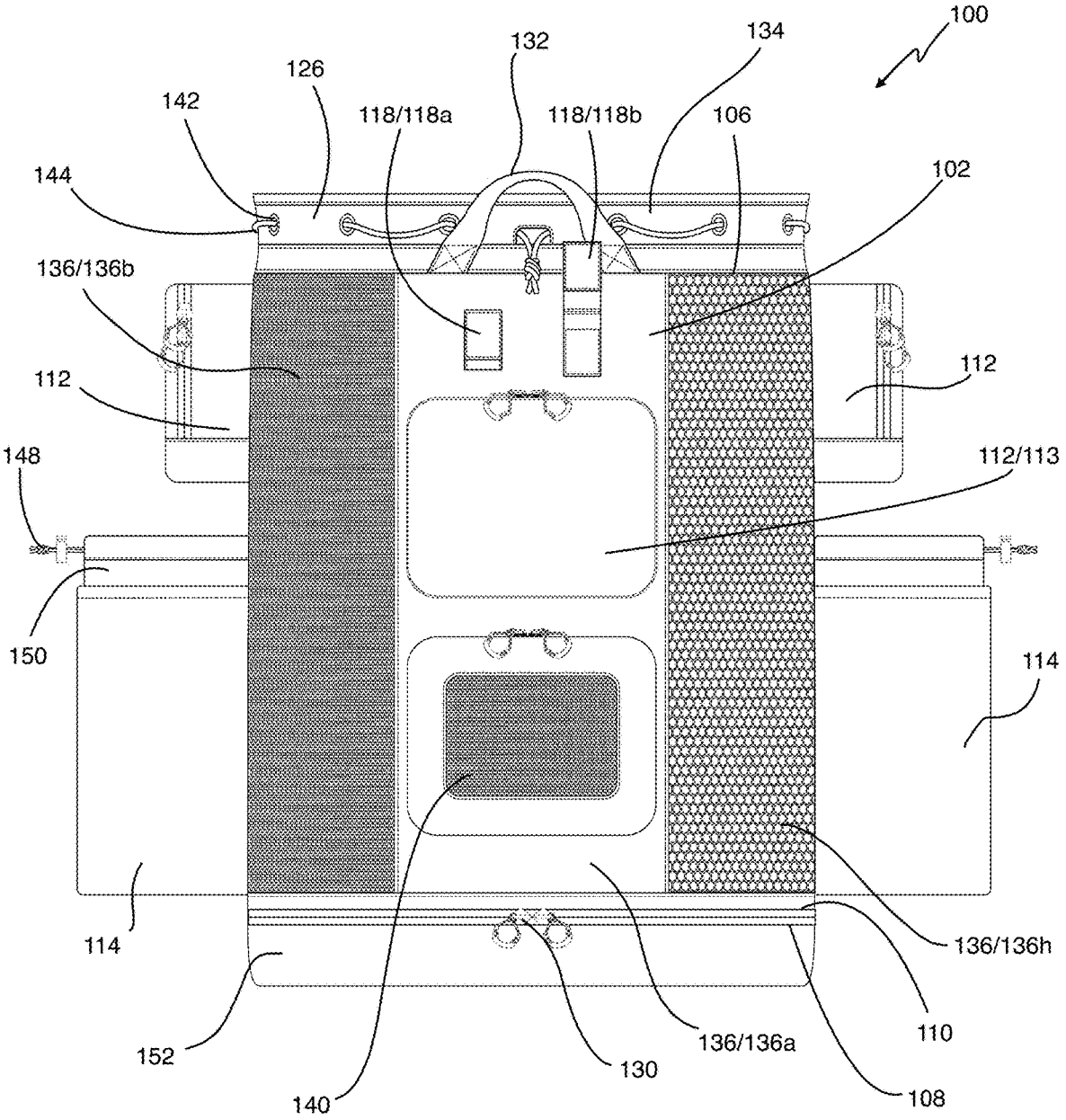
FIG. 1 illustrates a front view of the enhanced sporting equipment bag.

The invention herein provides a solution for limitations of equipment bags, namely soccer ball bags, that are currently available in the market. The invention includes a uniquely configured bag capable of solving the above issues.

As stated above, standard soccer ball and sporting equipment bags are limited in capacity and functionality. They only carry soccer balls in a singular internal compartment. Further, the number of Size 5 soccer balls vary between 12-16 balls for medium to large size bags. This market-standard construction may be appropriate merely for the transportation of soccer balls, but when more equipment is needed, for instance for traveling sports teams or non-permanent sporting events and practices, more equipment and a higher capacity is needed. Most solve this problem by simply increasing the number of mesh ball carriers and equipment bags, however, with an increase in the number of bags, a higher likelihood of leaving something behind arises.

However, inefficiencies in technology and construction were amplified by the COVID-19 virus outbreak, leading to months of soccer training with an increase in restriction on how to train players. The players were not allowed to touch the balls and they could only wear one training vest, these guidelines were put in place for every piece of equipment that the players could come into contact. The current ball bags were not designed to help coaches stay organized and prevent infection. This resulted in a need for equipment carriers with, not only increased space, but uniquely configured compartments and arrangements to accommodate the increase in variety of equipment that must be carried by a single person.

The invention herein solves these problems by providing a uniquely configured bag capable of solving the issues plaguing the state-of-the-art sporting equipment bags. The present invention is directed to a soccer training equipment bag that overcomes the limitations of conventional bags. The bag features a larger diameter to accommodate 20 size-5 soccer balls. It incorporates stretchable mesh panels that evenly distribute the pressure exerted by the balls, enhancing bag durability. Side pockets provide storage for training vests, with clear options for breathability and opaque options for privacy. Additional compartments, including a unique bottom compartment, offer versatile storage for equipment such as pop-up soccer goals, tactics boards, and agility rings. The bag's design includes features like side handles for tandem carrying, a hook-and-loop pump holder, drainage capability, and an easily adjustable strap with a key holder. The multifunctional design caters specifically to coaches overseeing larger groups of players.

A high-quality sports equipment bag should possess several crucial qualities to effectively meet the needs of athletes, coaches, and trainers. First and foremost, its capacity and storage must be sufficient to comfortably hold all the necessary gear, with multiple compartments, pockets, and dividers to enhance organization and prevent equipment from becoming jumbled. Durability and material are also paramount. The bag should be constructed from robust materials capable of withstanding the rigors of sports activities and frequent use. Features like quality zippers, reinforced stitching, and resistant fabrics contribute to the bag's longevity. Comfort and ergonomics play a significant role in ensuring ease of use. Padded shoulder straps, ergonomic handles, and balanced weight distribution make carrying the bag more comfortable, especially during extended periods of transport. Ventilation and breathability are essential to prevent foul odors and the growth of bacteria, particularly for sports equipment bags. Mesh panels, breathable fabrics, or compartments designed for wet gear contribute to proper air circulation. Accessibility is key for quick access to items during training sessions or competitions, especially for frequently used items like water bottles or personal belongings. Specialized compartments offer added convenience and organization. Hygiene and maintenance are important considerations, especially in light of health concerns. Bags with breathable and easy-to-clean materials help maintain a sanitary environment. Versatility is valued, as a bag that can adapt to different sports or training activities provides added flexibility. Modular designs that allow for customization based on specific gear needs offer even more convenience. Portability and storage are significant factors when the bag is not in active use. Bags that can be folded, collapsed, flattened, flexed, or compressed for storage make it easier to transport and store. Weather resistance, with water-resistant or waterproof materials and designs, is important to shield equipment from rain, spills, and other environmental factors. A well-designed sports equipment bag should strike a balance between these qualities to meet the demands of the sports environment while offering enhanced usability and convenience.

The enhanced sporting equipment bag as described in the present invention may be used to provide a sporting equipment bad that is capable of being an all-inclusive soccer training system, capable of carrying and servicing several different types and pieces of equipment in a single inclusive bag design. The enhanced sporting equipment bag as described in the present invention may also be used to provide a system capable of carrying an expanded capacity of soccer balls above the standard maximum of sixteen. The enhanced sporting equipment bag as described in the present invention may further be used to provide a system capable of displaying an easily accessible plurality of pockets configured to hold a minimum of fifteen training vests per pocket. And, the enhanced sporting equipment bag as described in the present invention may be used to provide a compartment including and capable of carrying foldable goals and coach tactical pads, as well as cones of various geometries. This apparatus and system are particularly shown in FIGS. 1-6.

FIG. 1 illustrates a front view of the enhanced sporting equipment bag 100. Further shown in the figure are the elements of the malleable cylindrical body 102, upper area of contain compart 106, integrated base panel 108, lowermost area of containment compartment 110, pockets 112, privacy pocket 113, pouches 114, hook and loop air pump holder 118, hook and loop straps 118*a*/118*b*, upper closable opening 126, a concentric zipper 130, circumferential structural ridge 134, flexible panels 136, a first non-mesh panel 136*a*, a first stretchable mesh panel 136*b*, a second non-stretchable mesh panel 136*h*, a view panel 140, upper cord concentric pocket 142, internal drawstring 144, pouch drawstring 148, pouch upper lip 150, and base compartment 152.

Figure 2:
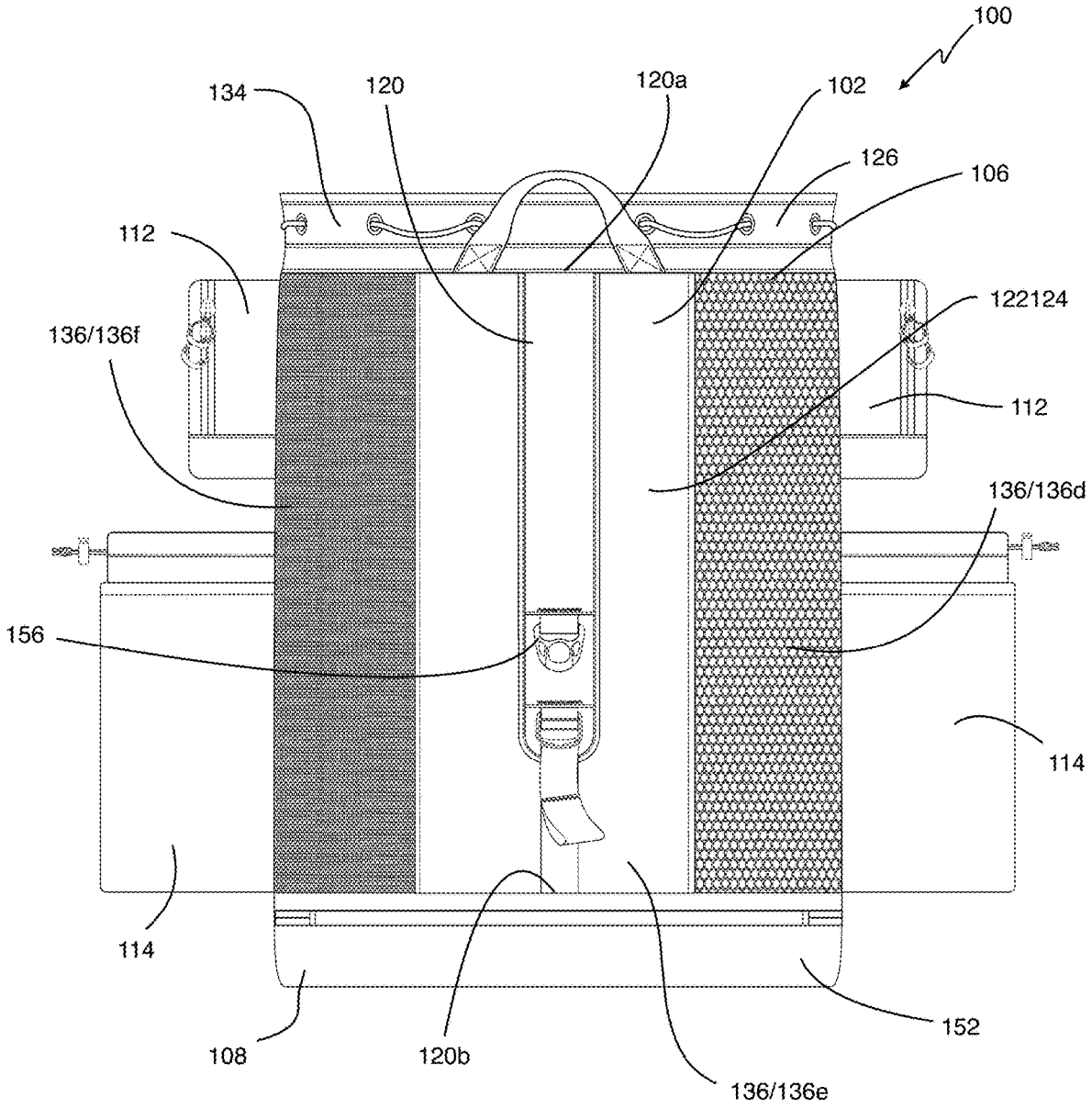
FIG. 2 illustrates a rear view of the enhanced sporting equipment bag.

FIG. 2 illustrates a rear view of the enhanced sporting equipment bag 100. Further shown in the figure are the elements of the malleable cylindrical body 102, upper area of contain compart 106, integrated base panel 108, pockets 112, pouches 114, a chest strap 120, a top end of chest strap 120*a*, bottom end of chest strap 120*b*, upper closable opening 126, circumferential structural ridge 134, flexible panels 136, a first non-stretchable mesh panel 136*d*, a third non-mesh panel 136*e*, a second stretchable mesh panel 136*f*, base compartment 152, and keyring holder 156.

Figure 3:
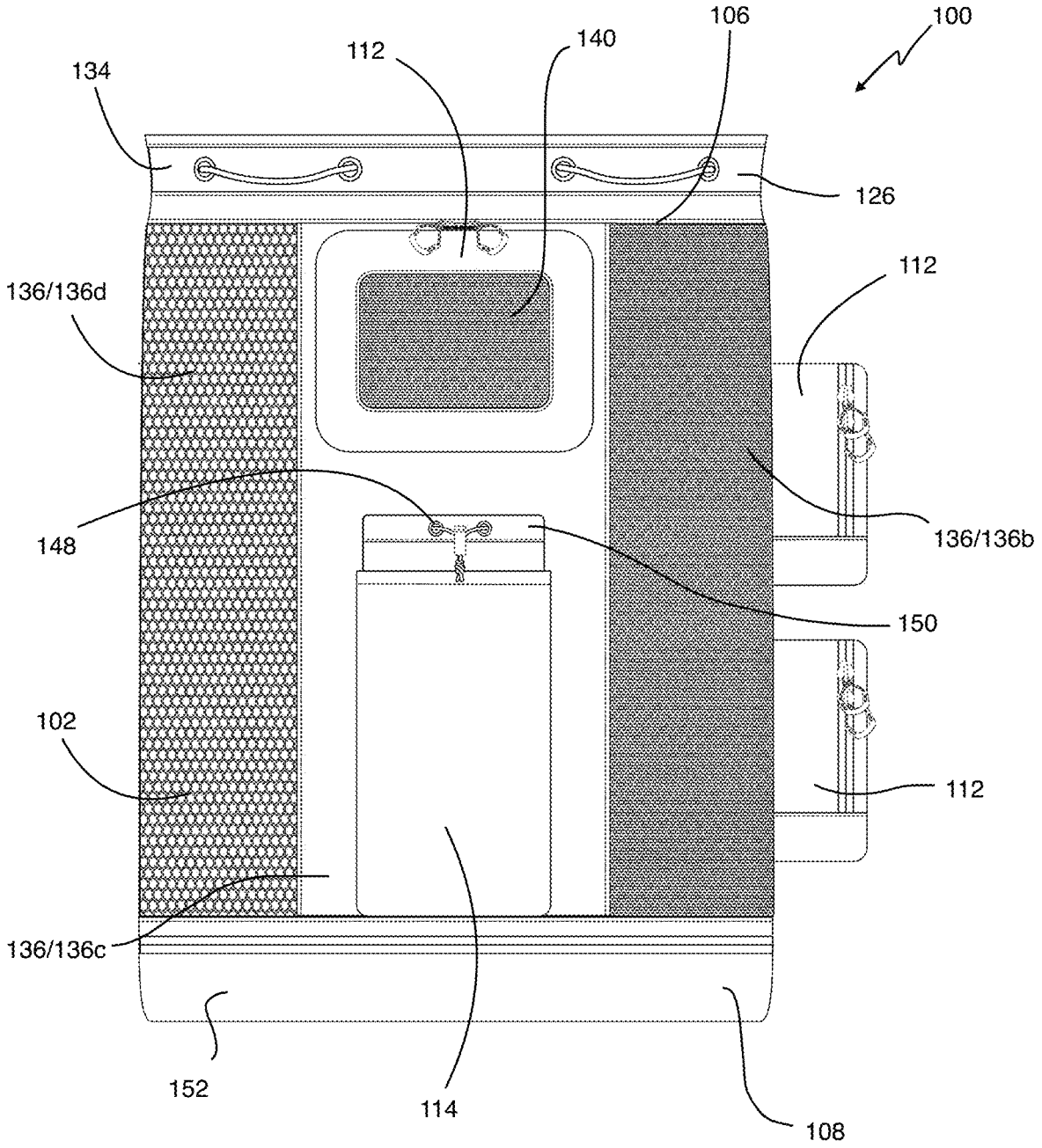
FIG. 3 illustrates left side view of the enhanced sporting equipment bag.

FIG. 3 illustrates left side view of the enhanced sporting equipment bag 100. Further shown in the figure are the elements of the malleable cylindrical body 102, upper area of contain compart 106, integrated base panel 108, pockets 112, pouches 114, upper closable opening 126, flexible panels 136, a first stretchable mesh panel 136*b*, a second non-mesh panel 136*c*, and pouch upper lip 150.

Figure 4:
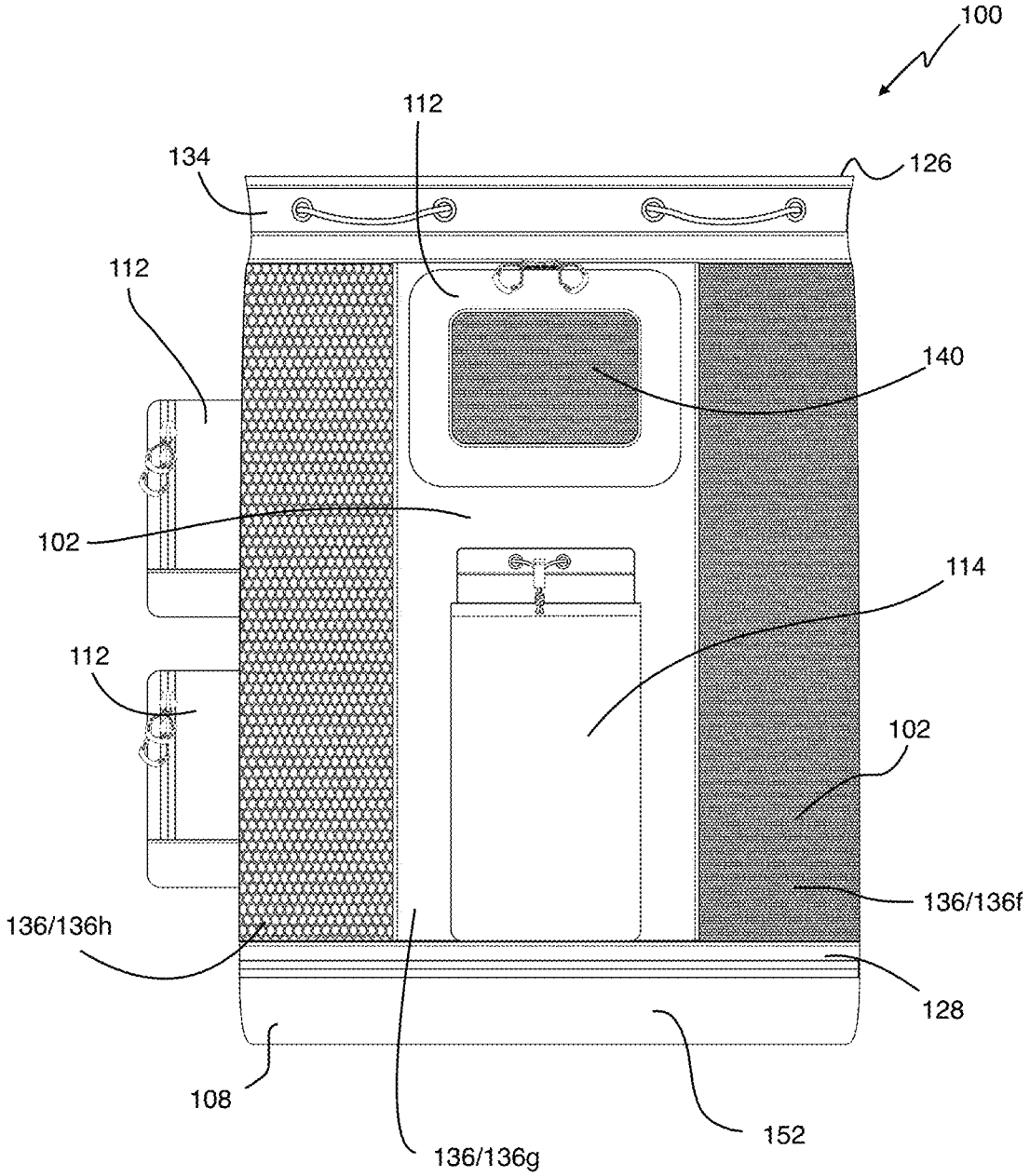
FIG. 4 illustrates right side view of the enhanced sporting equipment bag.

FIG. 4 illustrates right side view of the enhanced sporting equipment bag 100. Further shown in the figure are the elements of the malleable cylindrical body 102, integrated base panel 108, pockets 112, pouches 114, upper closable opening 126, lower closable opening 128, circumferential structural ridge 134, flexible panels 136, a second stretchable mesh panel 136*f*, a fourth non-mesh panel 136*g*, a second non-stretchable mesh panel 136*h*, a view panel 140, and base compartment 152.

Figure 5:
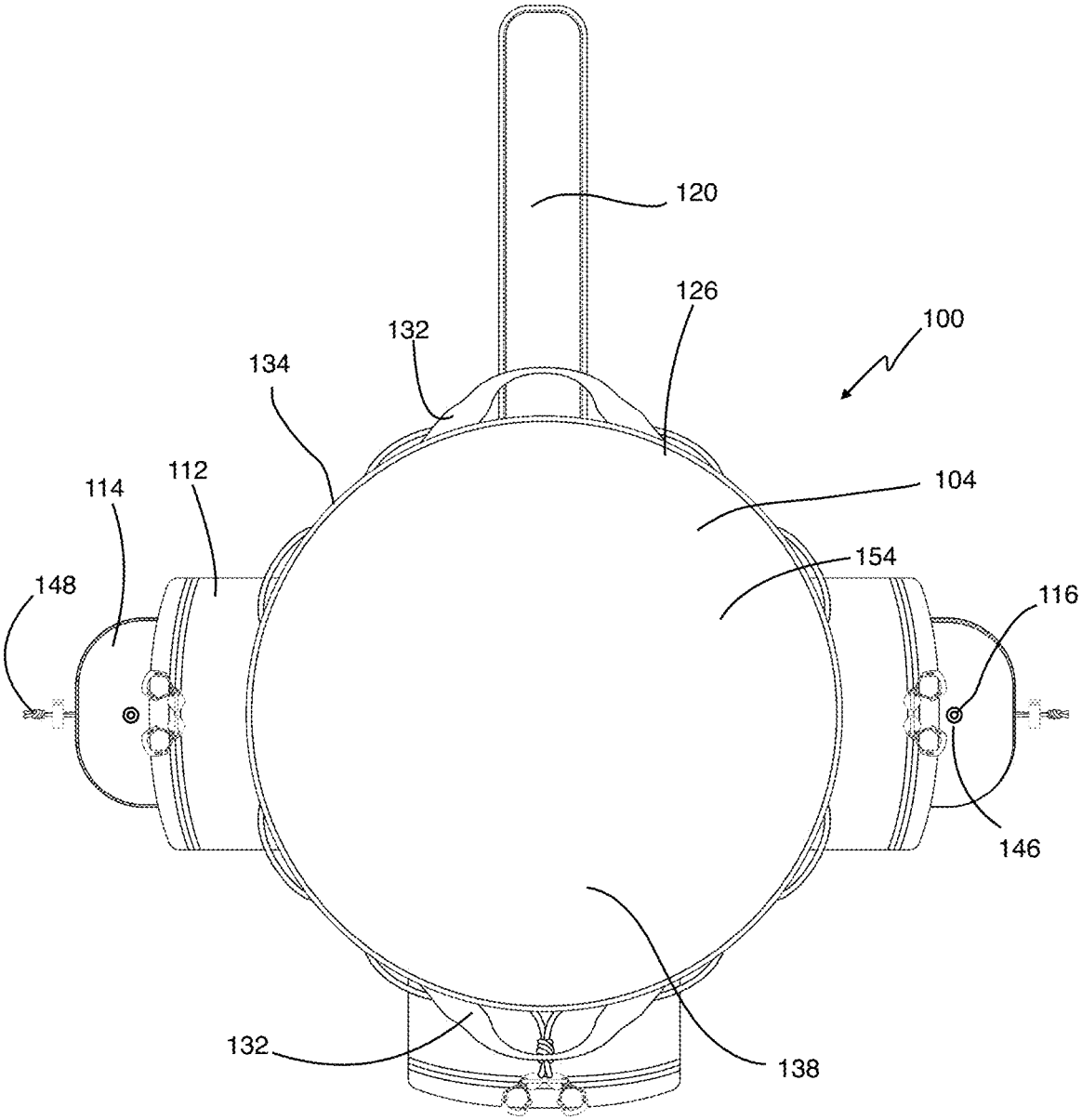
FIG. 5 illustrates a top view of the enhanced sporting equipment bag.

FIG. 5 illustrates a top view of the enhanced sporting equipment bag 100. Further shown in the figure are the elements of the central containment compartment 104, pockets 112, pouches 114, drainage holes 116, a chest strap 120, upper closable opening 126, side handles 132, circumferential structural ridge 134, compartment internal volume 138, grommets 146, pouch drawstring 148, and layer of material 154.

Figure 6:
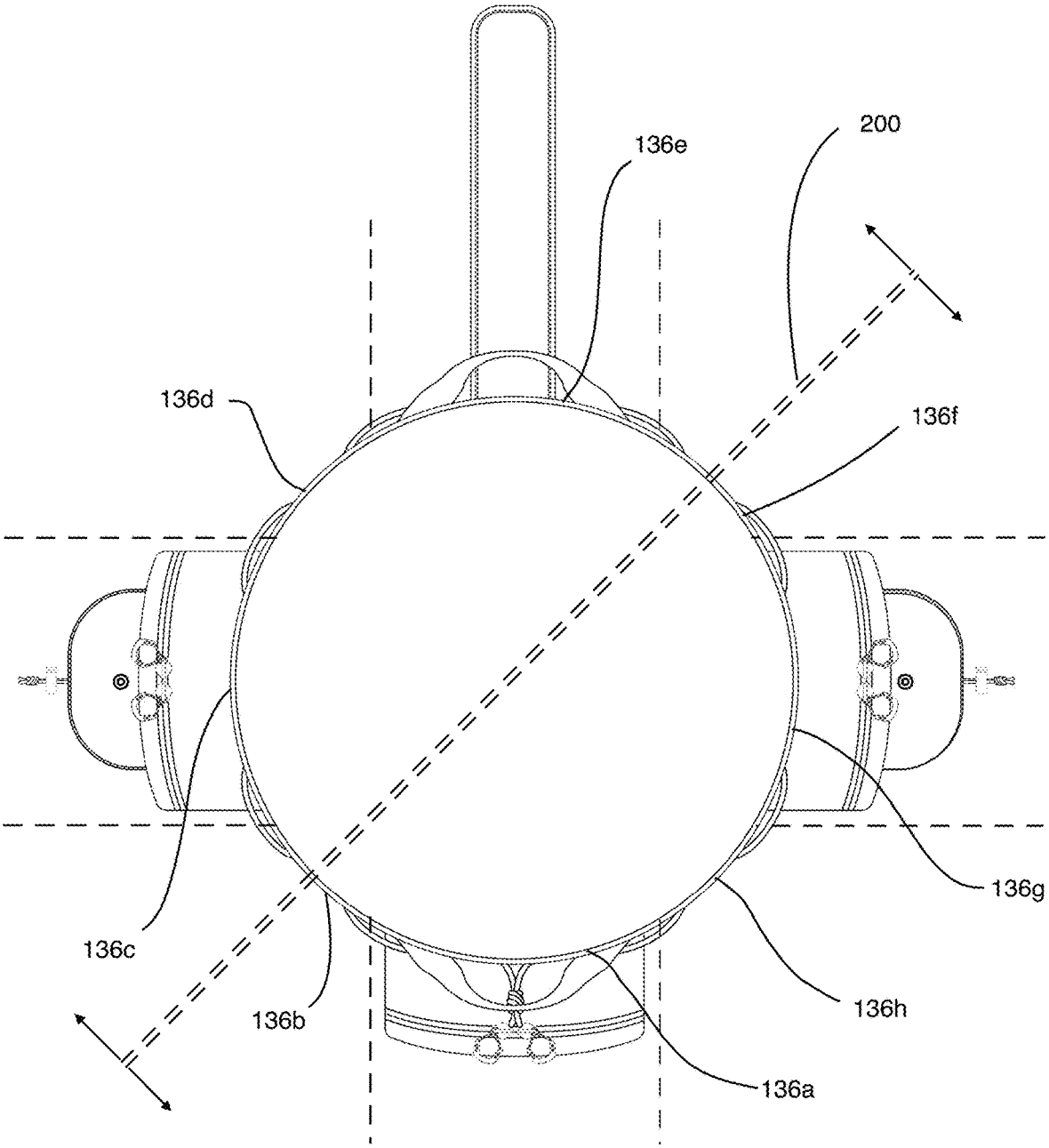
FIG. 6 illustrates a top view of the enhanced sporting equipment bag, with dashed lines conceptually indicating the breaks between the panels, and a double dashed line in the center of the stretchable mesh panels indicating the expansion of the bag.

FIG. 6 illustrates a top view of the enhanced sporting equipment bag 100, with dashed lines conceptually indicating the breaks between the panels 136*a*/136*b*/136*c*/136*d*/136*e*/136*f*/136*g*/136*h*, and a double dashed line in the center of the stretchable mesh panels indicating the expansion 200 of the bag 100.

In an exemplary embodiment, a multifunctional sports equipment bag 100 configured for versatile use, storage, and transport is provided. The multifunctional sports equipment bag 100 configured for versatile use, storage, and transport comprises a central containment compartment comprised of malleable cylindrical body 102 of flexible and stretchable materials. Geometrically, the central containment compartment 104 is bordered by an open upper area 106 and an integrated base panel 108 at a lowermost area 110. The multifunctional sports equipment bag 100 configured for versatile use, storage, and transport also includes a plurality of integrated surface mounted pockets 112, a plurality of integrated surface attached drawstring pouches 114, a plurality of drainage holes 116, and an integrated hook and loop air pump holder 118 comprising two hook and loop straps 118*a*/118*b*. The hook and loop straps 118*a*/118*b* are configured to a location where affixing an air pump will be unobstructed, such as toward a top of the bag, and should be oriented to keep the air pump horizontal so it does not slide out from its own weight.

The exemplary embodiment of a multifunctional sports equipment bag 100 configured for versatile use, storage, and transport further includes a chest strap 120 affixed to an outer surface 122 of a back side 124 of the central containment compartment 104, wherein a bottom end 120*b* of the chest strap 102 is affixed at the lower area 110 of the central containment compartment 104, and a top end 120*a* is affixed at a location towards an upper closable opening 126 at the open upper area 106.

The integrated base panel 108 of the multifunctional sports equipment bag 100 configured for versatile use, storage, and transport defines a lower closable opening 128 at a lower area 110 of the central containment compartment 104 attached by a concentric zipper 130 attaching an upper boundary 108*a* of the integrated base panel 108 to a lowermost boundary 110 of the central containment compartment 104.

In some embodiments, of the multifunctional sports equipment bag 100, a pair of side handles 132 are affixed distally apart from each other, each abutting and further securing to an upper circumferential structural ridge 134.

In some embodiments of the multifunctional sports equipment bag 100, the central containment compartment 104 of the bag 100 is capable of expanding and configured to receive up to twenty size-five soccer balls. For example, the diameter of an unstretched containment compartment 104 may have a 23" diameter measured when the opening 126 of the containment compartment 104 is in a circular shape, as Shown in FIG. 5, which would suggest an approximate circumference of 72". However, the flexible panels 136 will also allow the internal volume 138 to increasingly expand by including expandable fabrics, such as spandex, in the construction.

In some embodiments of the multifunctional sports equipment bag 100, the malleable cylindrical body 102 is formed from eight panels 136*a*/136*b*/136*c*/136*d*/136*e*/136*f*/136*g*/136*h*. Each panel in the eight panels is configured longitudinally parallel in a side-by-side arrangement, with each panel spans from top 106 to bottom 110. The eight panels include two stretchable mesh panels 136*b*/136*f*, two non-stretchable mesh panels 136*d*/136*h*, and four non-mesh panels 136*a*/136*c*/136*e*/136*g*, whereby the malleable cylindrical body 102 is formed from sequentially affixing each panel in sequence of a first non-mesh panel 136*a*, a first stretchable mesh panel 136*b*, a second non-mesh panel 136*c*, a first non-stretchable mesh panel 136*d*, a third non-mesh panel 136*e*, a second stretchable mesh panel 136*f*, a fourth non-mesh panel 136*g*, a second non-stretchable mesh panel 136*h*. The arrangement of wall panels 136*a*/136*b*/136*c*/136*d*/136*e*/136*f*/136*g*/136*h* is important to the shape the bag 110 takes when fully expanded to provide for stretch in a certain direction. A fully stretched bag 110 may have a controlled and predictable shape, in part due to the alternation between a stretchable mesh 136*b*/136*f* and a non-stretchable mesh 136*d*/136*h* (such as configuring the stretchable material directly across from another stretchable fabric) allows the stretched bag 100 to fit in tight spaces, such as the trunk of a car, which is not possible with current bags that expand in all directions, as the diameter of such bags exceed the average opening of a sedan or coupe trunk. Both the stretchable meshes 136*b*/136*f* and non-stretchable meshes 136*d*/136*h* allow breathability, but this unique configuration also provides for an easier and more ergonomic shape in carrying.

In some embodiments of the multifunctional sports equipment bag 100, at least one integrated surface mounted pocket 112 is affixed to a non-mesh panel 136*a*/136*c*/136*e*/136*g* of the four non-mesh panels 136*a*/136*c*/136*e*/136*g*, and is configured to a volume capable of receiving at least fifteen training vests. Typically, these pockets 112 may be 10"×8"×3.5". However, these pockets 112 may be used for several different purposes due to their large size, which may include applications including, among other things, storage of a comprehensive first aid kit. Some pockets 112 may include a view panel 140 for viewing internal contents of the at least one integrated surface mounted pocket 112. For some pockets 112, this view panel 140 may be a transparent plastic material. The plastic provides for water resistance, and, when combined with a polyurethane coating on the pocket, may make the pocket entirely waterproof, which is ideal when carrying important documents and electronic devices including mobile phones, car key fobs, and the like. In other embodiments where breathability is key, such as when the pocket 112 contains used athletic apparel, the view panel 140 is a see-through mesh material providing for both breathability as well as the ability to identify the contents of the pocket 112. A privacy pocket 113, may also be included whereby the privacy pocket 113 is constructed of a non-see through material. This is important when coaches have private or personal information, such as team contact information.

In some embodiments of the multifunctional sports equipment bag 100, the central containment compartment 104 includes a concentric pocket 142 at the open upper area 106, wherein the concentric pocket 142 includes an internal drawstring 144 thereby creating a closable opening at the open upper area 126. This helps keep the opening 126 of the bag 100 in a closed state. The rigid fabric of the concentric pocket 142 also protects the equipment bag 100 body from undue wear from repetitive opening and closing. Grommets 146 also allow the drawstring cord 142 to slip in and out, pressing on the rigid material to further secure the opening 126 closed.

In some embodiments of the multifunctional sports equipment bag 100, the at least one integrated surface attached drawstring pouch 114 of the a plurality of integrated surface attached drawstring pouches 114 is configured to a volume capable of receiving at least two hundred training cones. While pouches may exist in different sizes and configurations, at least one should allow for the storage of several training cones. These cones are typically stackable, allowing for large numbers of cones to be stacked inside the pouch 114. To comfortably fit the cones, some pouches 114 may be configured to a diameter of 7", and have a height of 12.5". In FIG. 1, a drawstring 148 upper lip 150 is shown, which extends the pouch 114 by another 2" in height, which is subject to constricting as the drawstring 148 constricts the closure, as the additional 2" of material forms a ceiling for the pouch 114.

In some embodiments of the multifunctional sports equipment bag 100, a plurality of drainage holes 116 exist. The drainage holes 116 are supported by grommets 146 to protect the fabric of the bag 100 from fraying. Drain holes 116 may exist in all major bases, such as the base of the pouches 114, pockets 112, and the base compartment 152 to allow draining in the event of rain or storage of wet equipment. These drainage holes 116 become necessary given the water retention capability of the material in part due to the use of materials such as polyurethane coatings, which provide water resistance at the expense of water retention.

In most embodiments of the multifunctional sports equipment bag 100, a layer of material 154 seals off the lower area 110 of the central containment compartment 104, whereby a lower containment 152 is created separate from the central containment compartment 104, accessible by unzipping concentric zipper 130. The lower containment 152 is configured to a volume capable of receiving a pair of pop-up style soccer training goals, a tactics board, and/or twelve circular agility rings. In order to achieve this, the diameter of the lower compartment 152 generally mirrors the diameter of the containment area 104 of the bag 100, that is, approximately 23" in diameter or more. A height of 4" may also be used to ensure proper fitment of the goals, tactic pads, rings, etc.

Another feature that is present in some embodiments is a keyring holder 156 integrated into the chest strap 120 constructed of a rigid material. This allows the user to attach keys, whistles, and other loose items that are not stored in the pouches 114.

In another exemplary embodiment, a method of configuring a multifunctional sports equipment bag 100 for versatile use, storage, and transport is provided. The method comprises providing a central containment compartment 104 comprised of malleable cylindrical body 102 of flexible and stretchable materials, wherein the central containment compartment 104 is bordered by an open upper area 126 and an integrated base panel 108 at a lowermost area 110, and the integrated base panel 108 defines a lower closable opening at a lower area 110 of the central containment compartment 104 attached by a concentric zipper 130 attaching an upper boundary 108*a* of the integrated base panel 108 to a lowermost boundary 110 of the central containment compartment 104. The method also includes providing a plurality of integrated surface mounted pockets 112, providing a plurality of integrated surface attached drawstring pouches 114, providing a plurality of drainage holes 116, providing an integrated hook and loop air pump holder 118 comprising two hook and loop straps 118*a*/118*b*, and providing a chest strap 120 affixed to an outer surface of a back side 122 of the central containment compartment 104, wherein a bottom end 120*b* of the chest strap 120 is affixed at lower area 110 of the central containment compartment 104, and a top end 120*a* is affixed at a location towards an upper closable opening 126 at the open upper area 106.

In some embodiments of the method of configuring a multifunctional sports equipment bag for versatile use, storage, and transport, the method further includes configuring the malleable cylindrical body 102 as individual eight panels 136*a*/136*b*/136*c*/136*d*/136*e*/136*f*/136*g*/136*h*, configuring each panel in the eight panels longitudinally parallel in a side-by-side arrangement, with each panel spanning from top 106 to bottom 110, and configuring the eight panels to include two stretchable mesh panels 136*b*/136*f*, two non-stretchable mesh panels 136*d*/136*h*, and four non-mesh panels 136*a*/136*c*/136*e*/136*g*, whereby the malleable cylindrical body 102 is formed from sequentially affixing each panel in sequence of a first non-mesh panel 136*a*, a first stretchable mesh panel 136*b*, a second non-mesh panel 136*c*, a first non-stretchable mesh panel 136*d*, a third non-mesh panel 136*e*, a second stretchable mesh panel 136*f*, a fourth non-mesh panel 136*g*, a second non-stretchable mesh panel 136*h*.

In some embodiments of the method of configuring a multifunctional sports equipment bag for versatile use, storage, and transport, the method further includes providing a layer of material 154 sealing off the lower area 110 of the central containment compartment 104, whereby a lower containment 152 is created separate from the central containment compartment 104, accessible by unzipping concentric zipper 130.

The method of configuring a multifunctional sports equipment bag for versatile use may further contain method steps of configuring the individual features for specific uses, such as increasing the diameters of the pouch 114 to accommodate the diameter of a stacked training cones, configuring the diameter and overall side of the cylindrical body to accommodate a plurality of soccer balls, but also configure the material of the side walls, flexible panels 136, to allow the walls 136 to stretch.

Further, the method may take advantage of the sizes of different parts of the bag 100, such as configuring the bottom portion 152 to receive pop-up-style soccer goals, which typically come in their own carrying bag because of the size, whereas the bag 100 disclosed herein can easily accommodate and provide for a containment structure capable of receiving the goals and keeping them substantially flat and free from deformation.

In addition, the method may also include steps such as configuring the arrangement of wall panels 136*a*/136*b*/136*c*/136*d*/136*e*/136*f*/136*g*/136*h* to provide for stretch in a certain direction, whereby a fully stretched bag may have a controlled and predictable shape, such as configuring the stretchable material directly across from another stretchable fabric, whereby the arrangement allows the stretched bag to fit in tight spaces, such as the trunk of a car, which is not possible with current bags that expand in all directions, as the diameter of such bags exceed the average opening of a sedan or coupe trunk.

While there has been shown and described above the preferred embodiment of the instant invention it is to be appreciated that the invention may be embodied otherwise than is herein specifically shown and described and that certain changes may be made in the form and arrangement of the parts without departing from the underlying ideas or principles of this invention as set forth in the Claims appended herewith.

I claim:

1. A multifunctional sports equipment bag configured for versatile use, storage, and transport, comprising:

a central containment compartment comprised of malleable cylindrical body of flexible and stretchable materials;

geometrically, said central containment compartment is bordered by an open upper area and an integrated base panel at a lowermost area;

a plurality of integrated surface mounted pockets;

a plurality of integrated surface attached drawstring pouches;

a plurality of drainage holes;

an integrated hook and loop air pump holder comprising two hook and loop straps;

a chest strap affixed to an outer surface of a back side of said central containment compartment, wherein a bottom end of said chest strap is affixed at lower area of said central containment compartment, and a top end is affixed at a location towards an upper closable opening at said open upper area; and said integrated base panel defines a lower closable opening at a lower area of said central containment compartment attached by a concentric zipper attaching an upper boundary of said integrated base panel to a lowermost boundary of said central containment compartment.

2. The multifunctional sports equipment bag configured for versatile use, storage, and transport, as recited in claim 1, further comprising:

a pair of side handles affixed distally apart from each other, each abutting and further securing to an upper circumferential structural ridge.

3. The multifunctional sports equipment bag configured for versatile use, storage, and transport, as recited in claim 1, wherein said central containment compartment is capable of expanding and configured to receive up to twenty size-five soccer balls.

4. The multifunctional sports equipment bag configured for versatile use, storage, and transport, as recited in claim 1, wherein:

said malleable cylindrical body is formed from eight panels;

each panel in said eight panels is configured longitudinally parallel in a side-by-side arrangement, with each panel spanning from top to bottom; and said eight panels include two stretchable mesh panels, two non-stretchable mesh panels, and four non-mesh panels, whereby said malleable cylindrical body is formed from sequentially affixing each panel in sequence of a first non-mesh panel, a first stretchable mesh panel, a second non-mesh panel, a first non-stretchable mesh panel, a third non-mesh panel, a second stretchable mesh panel, a fourth non-mesh panel, a second non-stretchable mesh panel.

5. The multifunctional sports equipment bag configured for versatile use, storage, and transport, as recited in claim 4, wherein at least one integrated surface mounted pocket of said plurality of integrated surface mounted pockets is affixed to a non-mesh panel of said four non-mesh panels, and is configured to a volume capable of receiving at least fifteen training vests.

6. The multifunctional sports equipment bag configured for versatile use, storage, and transport, as recited in claim 4, wherein at least one integrated surface mounted pocket of said plurality of integrated surface mounted pockets is affixed to a non-mesh panel of said four non-mesh panels, and includes a view panel for viewing internal contents of said at least one integrated surface mounted pocket.

7. The multifunctional sports equipment bag configured for versatile use, storage, and transport, as recited in claim 6, wherein the view panel is a transparent plastic material.

8. The multifunctional sports equipment bag configured for versatile use, storage, and transport, as recited in claim 6, wherein the view panel is a see-through mesh material.

9. The multifunctional sports equipment bag configured for versatile use, storage, and transport, as recited in claim 4, wherein at least one integrated surface mounted pocket of said plurality of integrated surface mounted pockets is affixed to a non-mesh panel of said four non-mesh panels, and defines a privacy pocket, whereby said privacy pocket is constructed of a non-see through material.

10. The multifunctional sports equipment bag configured for versatile use, storage, and transport, as recited in claim 1, wherein said central containment compartment includes a concentric pocket at said open upper area, wherein said concentric pocket includes an internal drawstring thereby creating a closable opening at said open upper area.

11. The multifunctional sports equipment bag configured for versatile use, storage, and transport, as recited in claim 1, wherein at least one a integrated surface attached drawstring pouch of said a plurality of integrated surface attached drawstring pouches is configured to a volume capable of receiving at least two hundred training cones.

12. The multifunctional sports equipment bag configured for versatile use, storage, and transport, as recited in claim 1, wherein each drainage hole in said plurality of drainage holes is supported by a grommet.

13. The multifunctional sports equipment bag configured for versatile use, storage, and transport, as recited in claim 1, further comprising:

a layer of material sealing off the lower area of said central containment compartment, whereby a lower containment is created separate from said central containment compartment, accessible by unzipping concentric zipper.

14. The multifunctional sports equipment bag configured for versatile use, storage, and transport, as recited in claim 1, wherein the lower containment is configured to a volume capable of receiving at least one of: a pair of pop-up style soccer training goals, a tactics board, and twelve circular agility rings.

15. The multifunctional sports equipment bag configured for versatile use, storage, and transport, as recited in claim 1, further comprising:

a keyring holder integrated into said chest strap constructed of a rigid material.

16. A method of configuring a multifunctional sports equipment bag for versatile use, storage, and transport, comprising:

providing a central containment compartment comprised of malleable cylindrical body of flexible and stretchable materials, wherein said central containment compartment is bordered by an open upper area and an integrated base panel at a lowermost area, and said integrated base panel defines a lower closable opening at a lower area of said central containment compartment attached by a concentric zipper attaching an upper boundary of said integrated base panel to a lowermost boundary of said central containment compartment;

providing a plurality of integrated surface mounted pockets;

providing a plurality of integrated surface attached drawstring pouches;

providing a plurality of drainage holes;

providing an integrated hook and loop air pump holder comprising two hook and loop straps; and providing a chest strap affixed to an outer surface of a back side of said central containment compartment, wherein a bottom end of said chest strap is affixed at lower area of said central containment compartment, and a top end is affixed at a location towards an upper closable opening at said open upper area.

17. The method of configuring a multifunctional sports equipment bag for versatile use, storage, and transport, as recited in claim 16, further comprising:

configuring said malleable cylindrical body as individual eight panels;

configuring each panel in said eight panels longitudinally parallel in a side-by-side arrangement, with each panel spanning from top to bottom; and configuring said eight panels to include two stretchable mesh panels, two non-stretchable mesh panels, and four non-mesh panels, whereby said malleable cylindrical body is formed from sequentially affixing each panel in sequence of a first non-mesh panel, a first stretchable mesh panel, a second non-mesh panel, a first non-stretchable mesh panel, a third non-mesh panel, a second stretchable mesh panel, a fourth non-mesh panel, a second non-stretchable mesh panel.

18. The method of configuring a multifunctional sports equipment bag for versatile use, storage, and transport, as recited in claim 17, further comprising:

providing a layer of material sealing off the lower area of said central containment compartment, whereby a lower containment is created separate from said central containment compartment, accessible by unzipping concentric zipper.

* * * * *